US005332223A

United States Patent [19]

Johnson

[11] Patent Number: 5,332,223

[45] Date of Patent: Jul. 26, 1994

[54] GOLF CLUB PUTTER AND METHOD OF MANUFACTURE

[76] Inventor: Norman E. Johnson, N2162 80th St., Plum City, Wis. 54761-8622

[21] Appl. No.: 123,059

[22] Filed: Sep. 20, 1993

[51] Int. Cl.[5] ..... A63B 53/04

[52] U.S. Cl. ..... 273/169; 273/173

[58] Field of Search ..... 273/167 R–177 A, 273/77 R, 164.1, 193 R, 194 R, 194 A, 162 R, DIG. 14; D21/214–220

[56] References Cited

U.S. PATENT DOCUMENTS

| | | | |
|---|---|---|---|
| D. 196,734 | 10/1963 | Solheim | 273/167 D |
| 4,123,056 | 10/1978 | Nakamatsu | 273/78 |
| 4,511,147 | 4/1985 | Olsen | 273/169 X |
| 4,573,685 | 3/1986 | Young | 273/173 |
| 5,090,703 | 2/1992 | Koumarianos | 273/167 E X |
| 5,176,384 | 1/1993 | Sata | 273/167 R |

*Primary Examiner*—Vincent Millin
*Assistant Examiner*—Sebastiano Passaniti
*Attorney, Agent, or Firm*—John W. Adams

[57] ABSTRACT

A golf club putter embodying this invention is formed from a peripheral rod, bent to provide peripheral weighting of the putter head both at the top and bottom, as well as from heel to toe. The method of manufacturing the putter head includes bending a rod of suitable rigid material, such as stainless steel, into the desired head shape, to provide an enclosed open area into which a striking face insert is installed and permanently held in place with a suitable adhesive filler material, such as a polyester fiberglass resin and attaching the putter head to the bottom of a shaft by means of a threaded connection.

4 Claims, 1 Drawing Sheet

GOLF CLUB PUTTER AND METHOD OF MANUFACTURE

BACKGROUND OF THE INVENTION

A great many golf club putters have been designed over the years. One of the most important construction features of a putter is to provide a concentration of the weight of the putter head around the periphery of the striking face of the putter . This tends to stabilize the execution of the golfer's putting stroke.

SUMMARY OF THE INVENTION

The putter embodying this invention includes a rod member, bent into a loop which forms the peripheral shape of the putter head. This closed loop is provided with an attachment stem formed along the upper leg of the loop and extends upwardly therefrom with suitable attachment means for connection with the bottom of the putter shaft, such as by being externally threaded for screw attachment with an internally threaded lower end of the shaft.

The loop provided by the bent rod forms the outer periphery of the putter head and has a rigid ball striking insert member which is fixed within the loop and secured in place by means of a suitable filler material, such as an epoxy resin, which surrounds the insert and positively anchors the same to the inside surfaces of the rod forming the closed loop. The lower edge of the insert is grooved to provide mechanical positioning of the insert within the loop whereby the insert conforms to the initial shape of the bottom element of the rod forming the loop enclosure and mechanically positions the surface of the two faces of the insert in the planes formed by the front and rear surfaces of the rod loop.

The method of manufacturing this putter includes producing the peripherally weighted club face by bending a rod into a shape to define the outer periphery of the club face and thereafter securing a striking plate within the opening defined by the bent outer rod.

DETAILED DESCRIPTION OF THE DRAWINGS

DETAILED DESCRIPTION OF THE PREFERRED EMBODIMENT

Figure 1:
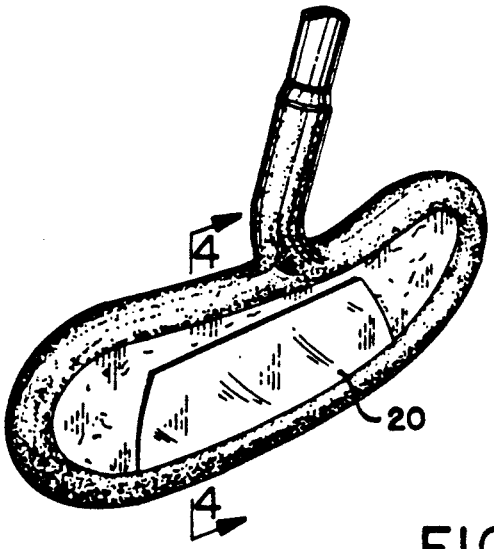
FIG. 1 is a perspective view, showing one side of the putter face.
Figure 2:
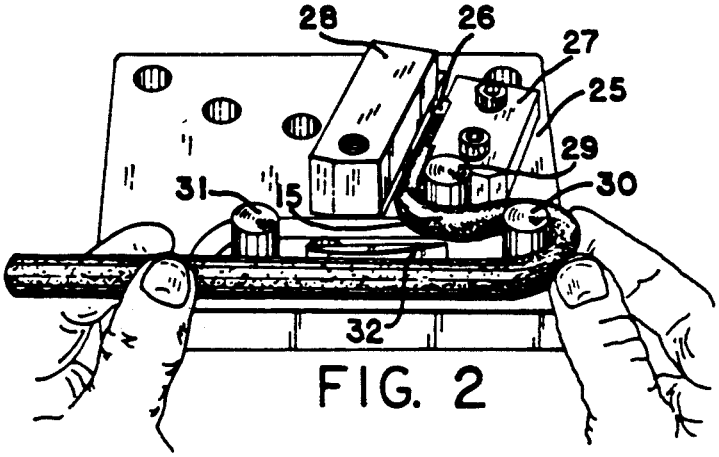
FIG. 2 is a bending jig, showing the method for bending the rod which forms the periphery of the putter face.
Figure 4:
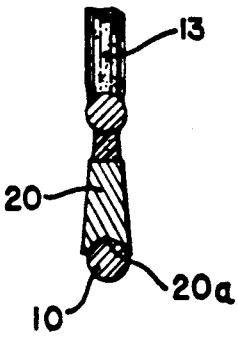
Figure 3:
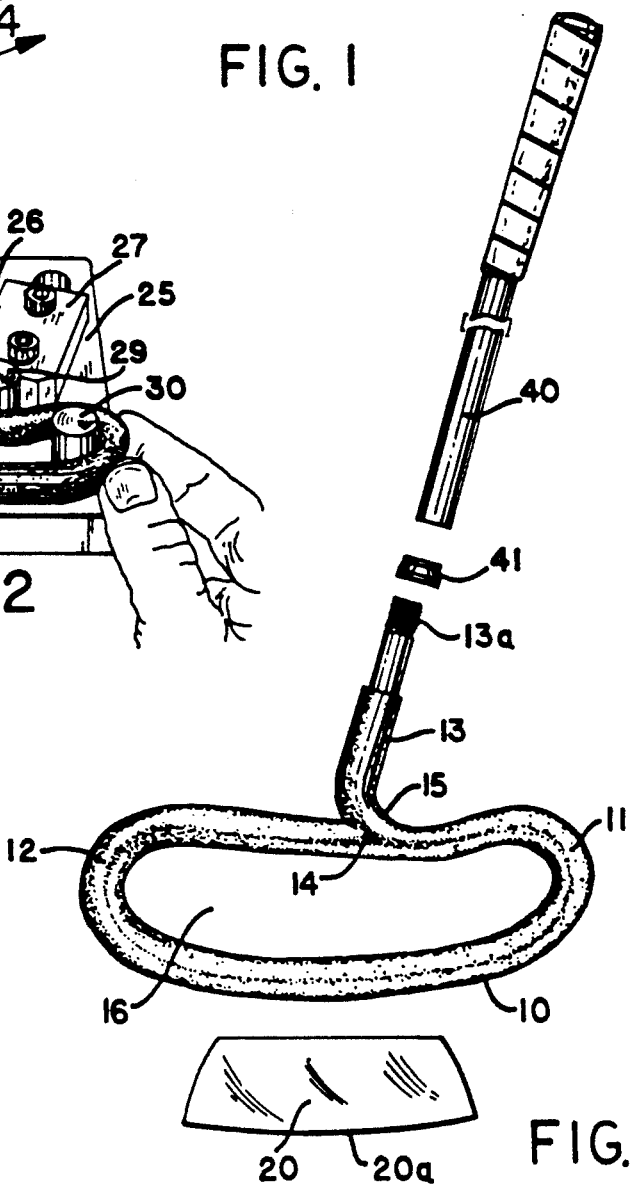
FIG. 3 is a side elevational view of the bent rod and also showing the separate insert member before being anchored with in the loop opening of the bent rod; and, FIG. 4 is a sectional view taken along the line 4—4 of FIG. 1.

As illustrated in the accompanying drawings, this invention provides a new golf putter construction which provides peripherally weighted club face with a rounded sole portion. This construction includes a rod of stainless steel approximately 7/16 of an inch in diameter, bent to form a slightly curved bottom sole portion 10, with a rear bend 11 and a front bend 12. An attachment stem 13 is formed, extending up from an intermediate position forwardly of the rear bend 11. The end of the rod extending back from the forward bend 12 is beveled as shown at 14 and is welded to the sharply curved neck portion 15 to complete the enclosure of the open area which defines the club face on both sides of the putter.

A flat ball-striking plate 20 is inserted into opening 16 and has a concavely curved lower seating edge portion 20*a* which receives the curved lower sole portion 10 of the rod . The insert plate 20 may be made from a suitable material, such as bronze, and is slightly thicker than the diameter of the rod to provide a flat striking surface in the central portion of the club face defined within the rod loop. Also, both faces of the plate have a loft of from approximately 2° to 3°, but not more than 5°.

The striking plate 20 is secured within the opening as by a suitable anchoring fiber material, such as an expoxy resin, #402 Polyester Fiberglass Resin product made by Dynatron-Bond Corp. of Atlanta, Ga., which completely fills the open area within the loop in the front and back of the insert 20 as shown. The resin is mixed with suitable coloring material to render the same opaque, preferably black in color.

A bending jig 25 is provided for obtaining the outer shape of the putter head . The upper stem 13 is positioned within a slot 26 formed between the two blocks 27 and 28, and the initial bend 15 is formed in the rod around the post member 29. The rod is then bent around the rear post member 30 and passes therefrom to the third post member 31 across the block member 32 which produces the desired bend in the sole portion 10. The front bend 12 is then formed around the post member 31. The block 28 is removed for this final bend, and the rod position extending rearwardly from the forward bend 12, formed at the post 31, is cut off on a beveled angle, and the beveled end 14 is welded to the sharply curved portion 15, as stated previously. Heat is applied to facilitate forming the various bends in the rod.

The upper stem 13 is provided with external threads 13*a* which mate with internal threads formed in the lower portion of the shaft 40, and a ferrule 41 may be used to provide a smooth connection between the lower end of the club shaft and the upper stem 13*a* of the club head.

The method of manufacturing the putter head includes initially providing a rod of stainless steel or the like which can be bent into the desired shape of the club face, bending the rod around suitable jig elements to form the desired shape, welding the end of the rod to the neck of the putter formed by the initial bend therein to close the loop forming the putter face, securing a ball-striking plate in the opening defined by the enclosing loop formed by the bent rod, and providing means for attaching the putter head to a putter shaft.

What is claimed is:

1. A golf putter, comprising a rod bent to form the outer periphery of a putter head and defining an open area therewithin, a striking plate inserted into the open area, means for securing the plate to the bent rod, and means for attaching a putter head to the bottom of a putter shaft.

2. The structure set forth in claim 1 wherein the means for anchoring the plate to the bent rod comprises an epoxy resin.

3. The structure set forth in claim 2 wherein the resin material is mixed with a coloring ingredient to render the same opaque.

4. The method of manufacturing a putter head, comprising initially providing a rod of bendable material, bending the rod to form the outer periphery of a putter head to define an open face area therewithin, inserting a striking plate into the open area to provide a ball-striking surface, and anchoring the striking plate within the open area defined by bent rod.

* * * * *